United States Patent [19]

Gross et al.

[11] 4,442,745

[45] Apr. 17, 1984

[54] LONG DURATION APERIODIC MUSICAL WAVEFORM GENERATOR

[75] Inventors: Glenn Gross, Chicago; Douglas R. Moore, Vernon Hills, both of Ill.

[73] Assignee: Norlin Industries, Inc., White Plains, N.Y.

[21] Appl. No.: 144,286

[22] Filed: Apr. 28, 1980

[51] Int. Cl.[3] ..... G10H 1/00

[52] U.S. Cl. ..... 84/1.01; 84/1.19; 84/1.26

[58] Field of Search ..... 179/1 SM; 84/1.01, 1.19, 84/1.26, 1.24

[56] References Cited

U.S. PATENT DOCUMENTS

| | | | |
|---|---|---|---|
| 3,763,364 | 10/1973 | Deutsch et al. | 84/1.03 X |
| 4,184,403 | 1/1980 | Whitefield | 84/1.19 |
| 4,383,462 | 5/1983 | Nagai et al. | 84/1.01 |

*Primary Examiner*—Forester W. Isen

*Attorney, Agent, or Firm*—Ronald J. Kransdorf

[57] ABSTRACT

This is an electronic organ which economically simulates long duration aperiodic musical waveforms, such as the clash of cymbals. It employs the digital waveform generation technique, in which successive instructions are read out of a memory to determine the amplitude of the waveform at successive sample points. To save memory capacity, the memory addresses are rescanned; and to avoid audible discontinuities the scan direction recirculates numerically back and forth across the address field. Despite the bidirectionality of the scan, monotonic decreases in amplitude and in higher harmonic content are achieved. The monotonic decrease in amplitude is accomplished by impressing an exponentially declining envelope upon the digitally generated amplitudes. The monotonic decrease in higher harmonic content is accomplished by preventing the rescan from returning to a memory region of greater harmonic content after it has once entered a region of lesser harmonic content.

19 Claims, 7 Drawing Figures

LONG DURATION APERIODIC MUSICAL WAVEFORM GENERATOR

This invention relates generally to electronic musical instruments, particularly those which construct musical waveforms from a plurality of digital instructions stored in a memory.

BACKGROUND AND PRIOR ART

Electronic musical instruments fall into two broad types. The older of these two types consists of those instruments which use various types of oscillators or clock sources as the ultimate source of a musical waveform. In instruments of this type the spectral characteristics (harmonic content, etc.) of the waveform obtained is inherently limited by the electrical characteristics of the source and of various filtration circuits which are used to modify the waveform downstream.

Another type of instrument, developed in more recent years, is not so limited. This type generates a musical waveform the amplitude of which, at each one of a plurality of sample points, is dictated by an amplitude instruction stored at a selected address in a digital memory. Thus, the waveshape is not simply a function of one or more electronic circuit parameters. This technique, which will be referred to hereinafter as "digital" waveform generation, allows considerably more flexibility in generating musical waveforms, because it permits any succession of amplitude values which can be specified by a series of numerical instructions stored in a memory.

But it is also subject to the disadvantage of excessive demand for memory capacity under certain circumstances. If the waveform to be generated is of long duration, up to as much as thirty seconds, then the required number of amplitude instructions is too great to be stored economically, and without special techniques the memory cost becomes prohibitive.

Increasing the spacing between amplitude sampling points would effectively reduce the total number of amplitude instructions to be stored, but that is an unpalatable alternative because resolution is thereby lowered to the point where audio quality is perceptibly impaired.

At least one prior art reference, U.S. Pat. No. 3,763,364 of Deutsch and Ashby, has disclosed a technique of recirculatory memory addressing as a means of reducing the memory capacity requirement in a digital waveform generator. When the last in a series of waveform amplitude instructions has been retrieved from memory, the same series of amplitude instructions is simply re-used over and over again, as long as the generated waveform lasts.

Instead of scanning the memory addresses in the same direction on each iteration, however, Deutsch et al reverse the numerical direction of address scan at the conclusion of each complete sweep, and scan back in the opposite numerical direction. The result is a series of back-and-forth address sweeps: forward, rearward, forward, rearward, and so on as long as the waveform lasts. In this context "forward" means an initial numerical direction of memory scan (normally, but not necessarily, the direction of increasing numerical address); while "rearward" means the return direction (normally, but not necessarily, the direction of decreasing numerical address). The advantage of such direction reversal is that it eliminates sudden discontinuities in the waveform amplitude at the end of each scan, which would produce audible distortion of the music.

But Deutsch et al only show how to use the direction reversal approach for producing a periodic waveform. The Deutsch instrument uses a stored sequence of waveform amplitude instructions one quarter cycle in length. The first forward address scan thus produces a first quarter wavelength of the output waveform, and the first rearward return scan produces a second quarter wavelength. The third quarter cycle is produced by a repeat forward scan, and thus is an exact repetition of the first quarter cycle. The fourth quarter cycle is produced by a repeat rearward scan, and thus is an exact repetition of the second quarter cycle. The waveform continues to repeat in that fashion (all odd quarter cycles alike, all even quarter cycles alike) for as long as the waveform lasts. Thus, the waveform of Deutsch et al is inherently periodic.

In certain circumstances it is necessary or desirable to produce a prolonged aperiodic waveform. For example, a clash of cymbals or some other percussive sound decaying over many seconds at an exponential rate cannot be effectively mimicked by a periodic waveform. Yet the duration of the sound is so great as to call for use of the recirculating scan technique in order to keep the memory capacity requirements within acceptable bounds. One of the objectives of this invention, therefore, is to adapt the recirculating scan technique to the generation of aperiodic waveforms such as exponentially decaying percussives.

The recirculating scan technique, as employed for example in Deutsch et al is also subject to another limitation. The recycling of the address scan at a steady rate (twice per cycle in Deutsch) produces flutter at the recycling frequency which is audibly detectable in the musical output. In a prolonged musical sound such audible flutter is objectionable.

Finally, the strictly periodic recycling technique of Deutsch et al. precludes any change in the spectral characteristics (for example, a decrease in higher harmonic content) of the generated waveform. Such a change over the duration of a prolonged percussive decay waveform would make the resulting sound seem more natural.

BRIEF SUMMARY OF THE INVENTION

In order to generate an aperiodic waveform, this invention makes use of an amplitude control device to produce an aperiodic exponential decay in amplitude even when the memory is being scanned over addresses which have already been covered at least once before. For greater realism in mimicking percussive sounds, the initial sudden increase in amplitude at the onset of percussion (and preferably the steep initial decay of amplitude thereafter) are accomplished exclusively through the selection of appropriate stored amplitude instructions, and these particular instructions are not thereafter re-scanned. Only when the slope of exponential decay has become shallower does the memory-saving address recirculation technique come into use, whereupon the amplitude control device is effective to continue the exponential decay (an aperiodic waveform) even though memory addresses are being rescanned and thus amplitude instructions are being repeated.

In order to prevent the memory recirculation technique from producing a periodic flutter at the recycling frequency, a psuedo-random pattern of recycling is employed, in which the starting points of the various forward scans are not all the same, and similarly the starting points of all the rearward scans are not all the same. The result is that the length of time between scan phases is not repeated in a regular pattern, and thus there is no regular flutter rhythm to be detected.

If the waveform lasts long enough, eventually it will have to enter a recirculating pattern which does repeat itself exactly, in the manner of Deutsch et al. The period of iteration, however, is much longer than the mere half-cycle iteration period of Deutsch, so that the resulting periodic flutter is at a much lower frequency, and thus is not audible.

The shifting of scan direction reversal points during the recirculating scan not only solves the audible flutter problem, but also can be taken advantage of in another way. It can be used to make the waveform change its spectral character, for example, by decreasing its higher harmonic content over time, the better to mimic a natural percussive decay sound. This is accomplished by incorporating a larger content of higher harmonics in the amplitude instructions which are stored in those memory addresses reached earlier in the recirculation cycle, and incorporating a smaller content of such harmonics in the instructions which are stored in addresses reached later on, and by choosing the scan reversal points so that the recirculation pattern, despite its continuous changes of scan direction, makes overall progress toward the smaller harmonic content regions. Consequently, on the time scale of a number of direction reversals, the average higher harmonic content of the waveform will go from larger to smaller.

The region in which exact scan duplication can finally occur, during the terminal portion of a very long waveform, is confined to those memory addresses which have the particular spectral characteristic toward which the waveform has been progressing, e.g. the smallest content of higher harmonics. Thus, the progress toward such final spectral characteristic, although eventually arrested, is not reversed by returning to the memory addresses which have the earlier spectral characteristic.

These features of the invention briefly summarized, and others as well, will next be described in full detail in connection with the following drawings.

DRAWINGS

DETAILED DESCRIPTION OF THE PREFERRED EMBODIMENTS

Figure 1:
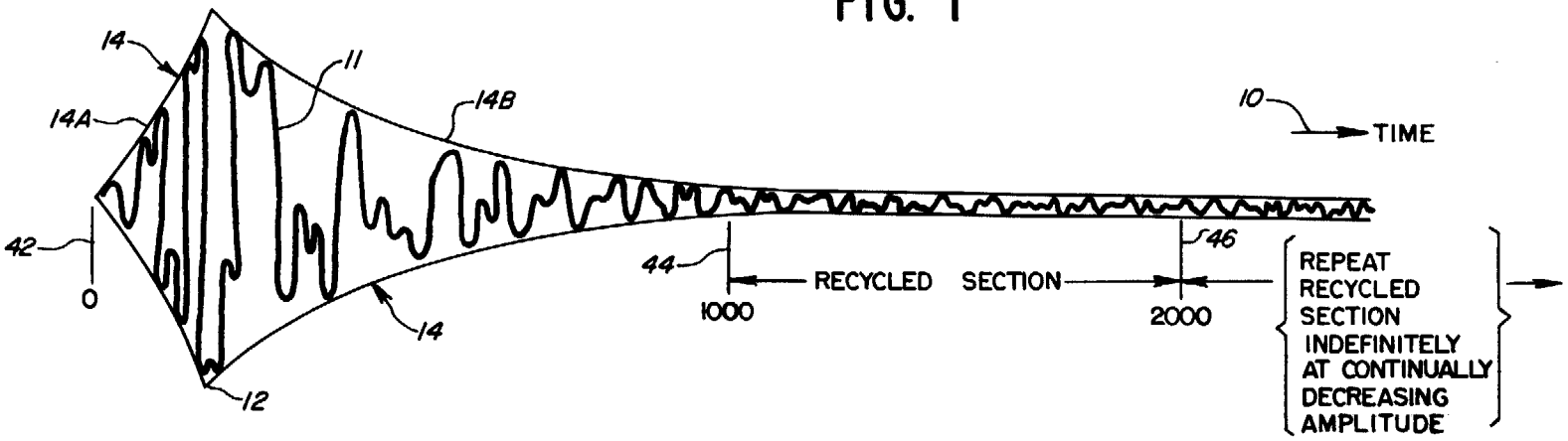
FIG. 1 is a graph of voltage amplitude versus time, and shows an electrical representation of a percussive sound oscillation waveform, together with its envelope.

The waveform diagram in FIG. 1 depicts an oscillating voltage 11 with an extremely rich harmonic content, which is designed to represent a percussive musical sound having a sudden onset and a very long exponential decay. Such an acoustic waveform is often encountered, for example, in the musical world when there is a clash of cymbals which is allowed to decay naturally over a prolonged period of time instead of being silenced by damping after a short interval. In this diagram, where arrow 10 indicates the time axis in the conventional manner, the envelope 14 of the oscillatory voltage 11 rises sharply and suddenly (see envelope segment 14A) to a peak 12 upon the occurrence of a percussive event, such as the clashing of the cymbals. From that peak, segment 14B of the envelope decays, rapidly at first, and then more and more slowly as the waveform continues. The decaying portion 14B of the envelope is in the form of an exponential curve.

This type of waveform is relatively difficult to generate using an oscillator or clock as the basic source of alternating voltage. A better approach, which is becoming more widely adopted, is to use the digital waveform generation technique, which is best appreciated by reference to FIG. 3. A waveshape memory 20, normally a read-only memory (ROM), stores a plurality of instructions in digital form at respective memory addresses. Each instruction represents the desired amplitude of the waveform 11 at a particular sampling point. If the sampling points are sufficiently close together, and if capacitive elements are used to smooth the transitions between consecutive sampling points, a waveform which is reconstructed using the amplitudes dictated by the stored instructions gives an accurate representation of the desired musical sound. The amplitude instructions corresponding to successive sample points in time sequence are stored at memory addresses which are addressable in a numerical sequence by an address counter 22, which in turn is stepped through its successive numerical states by a clock signal. Thus, as the address counter 22 steps through its numerical states in sequence, it addresses the proper sequence of addresses in the waveshape memory 20 and reads out the desired sequence of amplitude instructions in binary digital form on a cable 24.

With waveforms of the kind depicted in FIG. 1, which may continue through their prolonged exponential decay phase 14B for a period many seconds in duration, a point is eventually reached at which the capacity of the waveshape memory 20 would be exhausted, unless the memory is so large that it would not be economically feasible. The solution which the prior art has adopted for the problem of memory capacity is to dedicate some finite series of memory addresses to a particular waveshape 11, and then when the last address in that series is reached by the address counter 22, the same memory addresses are then rescanned so that subsequent portions of the waveshape 11 are repetitions of other portions which were previously retrieved from memory.

This is not done, however, by simply jumping directly from the last address in the series back to the first address in the series; because such an abrupt return would most likely cause an audible discontinuity in the amplitude of the waveform 11 at the point where the memory address recycling operation begins. Instead, the address counter reverses its numerical direction; after counting up numerically from the lowest to the highest memory address in the waveshape sequence, it counts back down through the same series of memory addresses in reverse numerical order. To illustrate, consider the diagram of FIG. 2 in which line 31 and its arrowhead represent the memory address counter counting up from memory address 0, the first address in the waveshape sequence, to memory address 2000, the last address in the waveshape sequence, while line 32 and its arrowhead represent the memory address counter counting back down from address 2000 through some of the same memory addresses in reverse numerical order. Since address 1999 follows address 2000 in the reverse counting sequence, the amplitude transition downward from address 2000 to address 1999 presents no greater discontinuity than the transition upward from address 1999 to address 2000. Thus, reverse recirculation has the advantage of avoiding audible discontinuities in waveform amplitude at any point where memory addresses begin to be rescanned.

As so far described, the technique of dealing with long waveforms through the memory retracing technique, with direction reversal, is no different from the prior art as exemplified by Deutsch et al. In accordance with this invention, however, the recirculating portion of the memory address sequence in FIG. 2 never does return below some selected address located between the lowest and highest memory addresses in the particular waveshape sequence. Note, for example, there are ten different scan segments 31 through 40 in FIG. 2, and that the first reverse counting sequence 32 returns only as far as memory address 1400, while subsequent reverse memory address counting sequences 34, 36, 38 and 40 only return as far as memory addresses 1100, 1000, 1300 and 1200 respectively. As a result, if the spectral characteristics dictated by the amplitude instructions stored in the first 1000 memory addresses differ, for example in higher harmonic content, from the spectral characteristics dictated by the amplitude instructions stored in the second 1000 memory addresses, then the waveform is easily divided into two separate portions: the portion having, for example, a larger content of higher harmonics, which terminates at address 1000 and which is not repeated because the memory recirculation program does not go any lower than memory address 1000; and a second portion which has, for example, a smaller content of higher harmonics, and is the only memory region rescanned by the recirculation pattern illustrated in FIG. 2.

The advantage of dividing a percussive waveform into a repeated and a non-repeated segment in this fashion is that the characteristics of a true percussive sound wave with long exponential decay can thereby be more faithfully represented. With reference once more to FIG. 1, the portion of the waveform 11 which occurs in the first 1000 memory addresses, i.e. between points 42 and 44, is very different, both in envelope amplitude and in harmonic content, from the portion of the waveform between addresses 1000 and 2000, i.e. between points 44 and 46. The segment 42–44 includes the rapid increase in the amplitude of envelope 14 represented by the rising portion 14A, as well as the rapidly diminishing initial portion of the exponential decrease 14B. In contrast, the remaining decrease in amplitude which occurs after point 44 is far smaller in magnitude, since it is near the asymptotic tail portion of the exponential decay curve 14B. As a result, section 44–46 lends itself to repetitive use of the stored amplitude instructions through the memory recirculation technique more readily than section 42–44.

In a naturally occurring percussive sound, there is a larger content of higher harmonics in the rapidly rising and rapidly decaying portions of the waveform than there is during the remaining asympototic portion of the exponential decay. This natural condition can be approximated if the higher harmonic content of waveform segment 42–44 exceeded that of waveform segment 44–46, and if the memory scan never returned to segment 42–44 once it concluded segment 44–46. In contrast, if the back-to-the beginning memory recirculation technique of Deutsch et al were employed in reproducing the waveform of FIG. 1, the memory recirculation sequence would have to retrace the rapidly rising envelope segment 14A and the rapidly falling portion of the envelope decay 14B, which would impair the realism of the resulting waveshape. In addition, if an attempt at spectral realism were made, by tailoring the stored amplitude instructions so that segment 42–44 had a larger content of higher harmonics than section 44–46, such attempt would have to be abandoned when the memory scan retraced its way back to section 42–44. Instead of causing the higher harmonic content of the waveform to decrease monotonically, the Deutsch et al technique would alternate between larger and smaller levels of higher harmonic content as the memory recirculation sequence cycled back and forth between segment 42–44 and segment 44–46.

Figure 2:
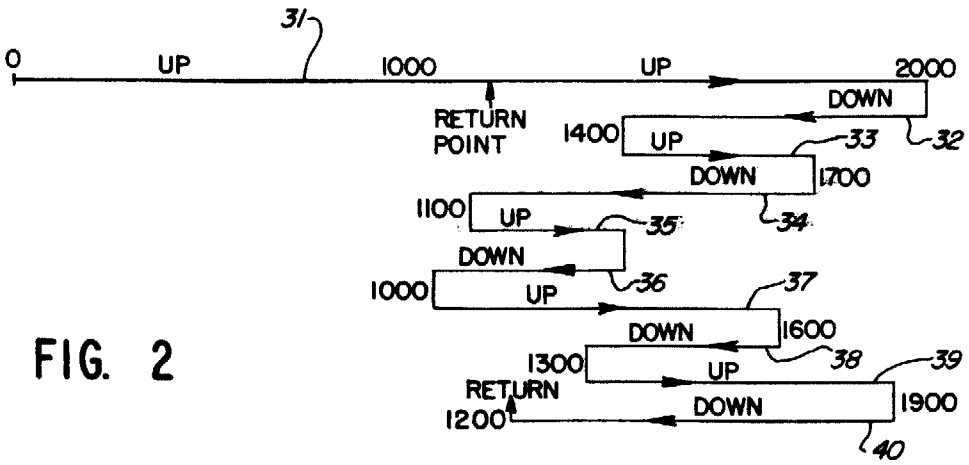
FIG. 2 is a diagram showing a memory address scan sequence for use in a musical instrument in accordance with this invention, for producing the sound waveform of FIG. 1.

In the present invention, however, as seen in FIG. 2, rearward scans 32, 34, 36, 38 and 40 do not return beyond the dividing point, address 1000, which corresponds to point 44 in FIG. 1. This, coupled with the fact that the amplitude instructions are chosen so that there is a larger content of higher harmonics in memory addresses 0 to 1000 (segment 42–44) than in memory addresses 1000 to 2000 (segment 44–46), guarantees that the waveform 11 will start out with a relatively large content of higher harmonics in the unrepeated section 42–44 and then go to a lower level of higher harmonic content throughout any part of segment 44–46, not only during the first forward scan 31 (FIG. 2) but also during all the repeat scans 32 through 40 as the counter cycles forwardly and rearwardly in the general area between memory addresses 1000 and 2000.

The initial amplitude increase in envelope segment 14A, and the subsequent rapid amplitude decrease in the first envelope decay phase 14B, are both achieved solely through the proper choice of amplitude instructions stored in memory addresses zero through 1000 (i.e. in waveform section 42–44). Beyond memory address 1000 (i.e. in waveform section 44–46) all the peak amplitudes stored at memory addresses 1000 to 2000 are the same, and the continuing decrease in the amplitude of waveshape 11 from address 1000 on is achieved solely by means of a declining envelope superimposed thereon. The envelope, therefore, must turn on at memory address 1000, before the recirculating scan begins at address 2000.

Figure 3:
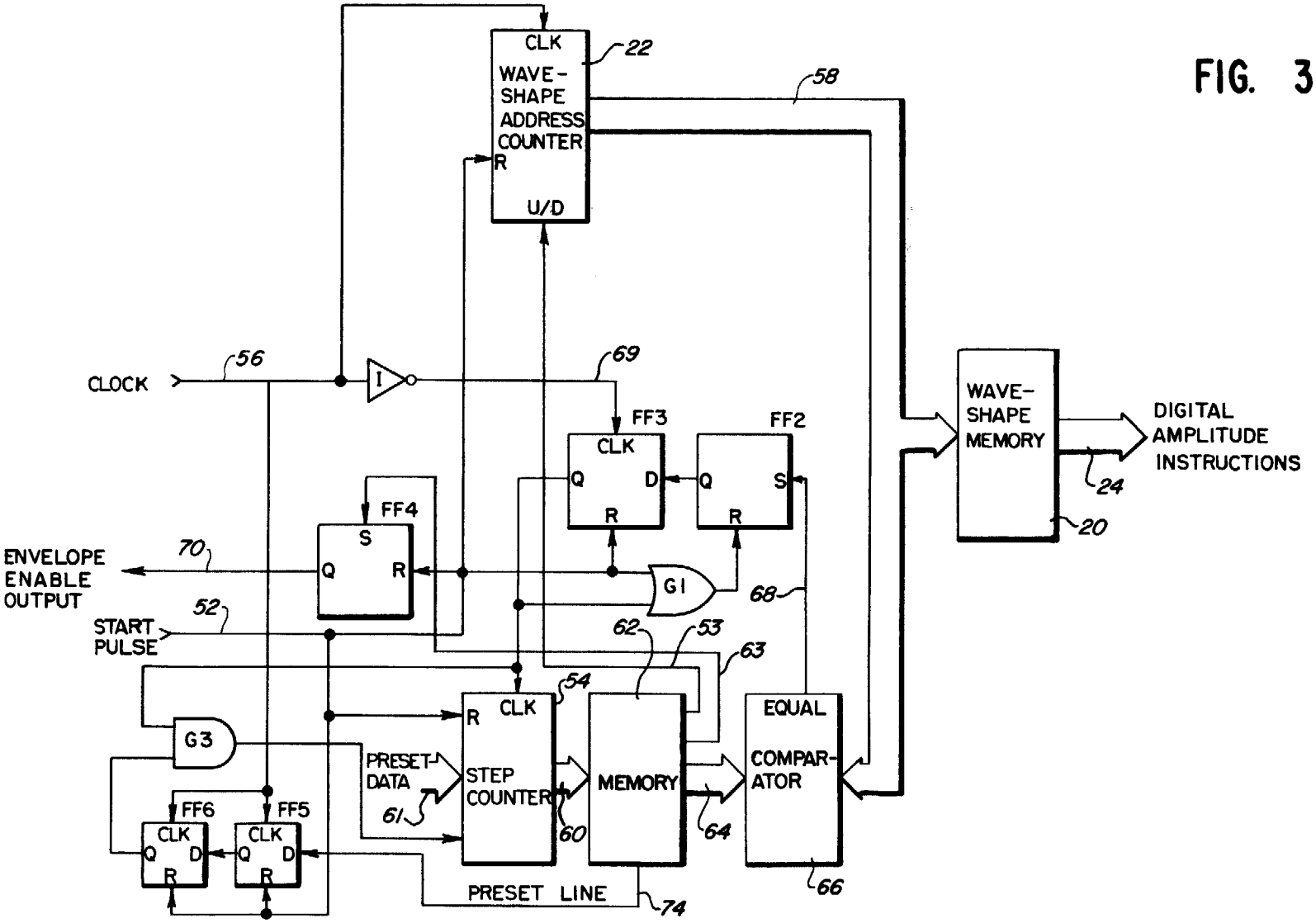
FIG. 3 is a functional block diagram of a portion of the instrument.

To appreciate how the memory scan sequence of FIG. 2 as well as such envelope characteristics are achieved, we will now examine in some detail the operation of the circuit seen in FIG. 3. At the start of each waveform generation cycle, a start pulse appears on a line 52. This start pulse resets the address counter 22 to zero, and also does the same thing with a recirculate step counter 54. In addition, the start pulse resets flip-flops FF2 through FF6. These operations establish the required initial conditions for waveform generation.

When the signal on a line 53 is low, it causes the address counter 22 to switch to the forward counting mode, i.e. the mode in which it counts numerically upward. The line 53 carries one bit of the output of a recirculate memory 62. That memory, which is preferably a ROM, has a zero stored in the corresponding place at its zero address. Therefore, when recirculate step counter 54 is initially reset to zero, the zero address of memory 62 is accessed, and the bit on line 53 will be a zero at that time, thus controlling the initial count mode of address counter 22. As a result, a clock input on line 56 causes the address counter 22 to count upward from zero through a sequence of consecutive numerical states. When the address counter is at count zero, its output on cable 58 accesses address zero of the waveshape memory 20. When the address counter steps to count one, it accesses memory address one, and so on through each successive numerical state of the address counter 22. As addresses zero, one, two, etc. of the waveshape memory 20 are accessed, the first, second, third, etc. amplitude instructions are read out of these memory addresses sequentially on cable 24.

The amplitude instructions appearing on cable 24 are in digital form, and must be converted to analog voltage form through the use of a digital-to-analog (D/A) converter. In addition, at some point the diminishing envelope must be superimposed upon the waveshape, so that the recirculating memory scan produces the desired aperiodic waveform of monotonically diminishing peak amplitude. The interaction between these two operations (D/A conversion and envelope superimposition) can be handled in any one of several alternative ways, illustrated by FIGS. 5 through 7.

Figure 5:
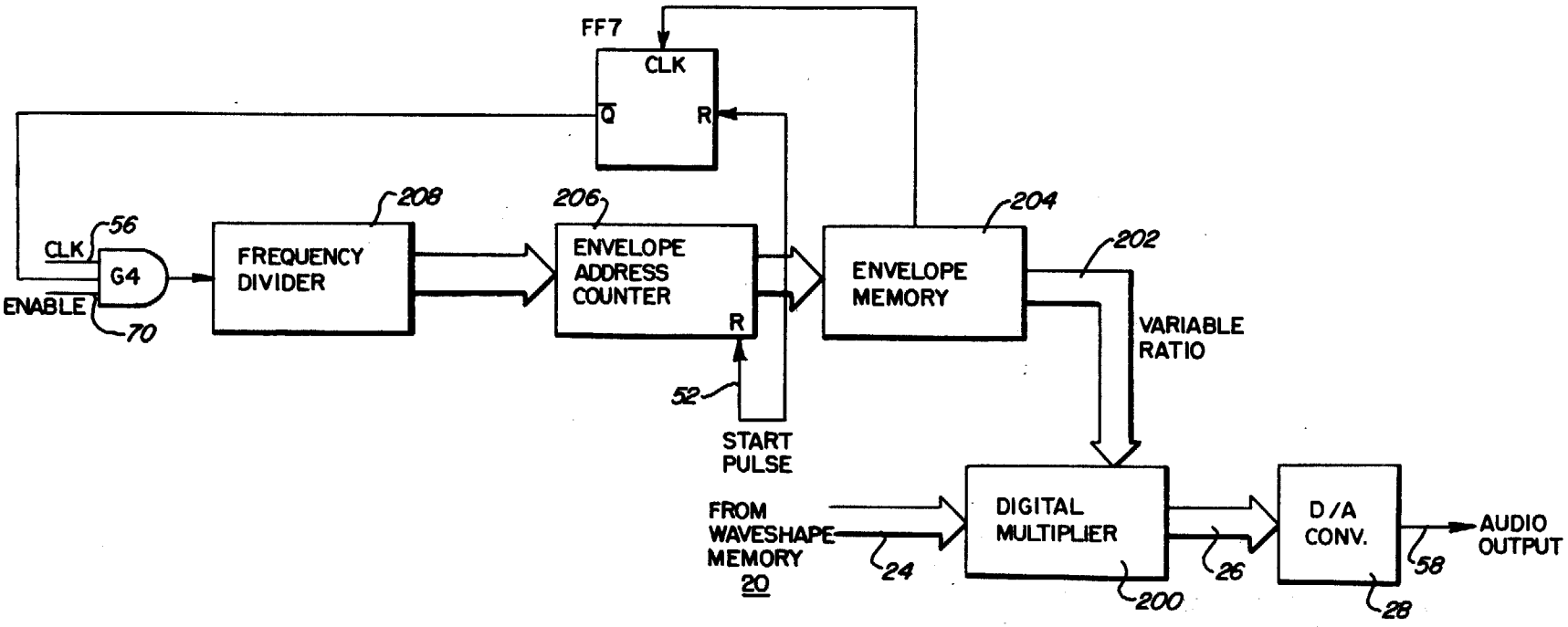
FIGS. 5 through 7 show alternative circuits for converting a series of digital amplitude instructions into a continuously varying, envelope-modified analog voltage waveform.

FIG. 5 illustrates an approach in which the envelope is impressed upon the waveform 11 while the amplitude instructions are still in digital form, and D/A conversion follows thereafter. The waveshape memory output cable 24 (see FIG. 3) goes to a digital multiplier 200 which multiplies by a variable ratio. The multiplication ratio can be selected from various values in the range from one to zero, depending upon digital instructions arriving over a cable 202 from an envelope memory 204. The latter, which is preferably a ROM, stores a series of envelope amplitudes in the form of digital instructions specifying a declining series of multiplication ratios to be used successively by the multiplier circuit 200. The multiplication ratio value stored at the first envelope memory address is one, which means that initially the digitally specified waveform amplitude values on cable 24 are passed through the digital multiplier 200 without change (they are multiplied by unity). The multiplication ratio values stored at subsequent envelope memory address decline from one through a series of monotonically decreasing fractional values to a final value of zero at the last envelope memory address. An envelope address counter 206 steps through a series of numerical states to scan the envelope memory addresses.

In order to make maximum use of the envelope memory's limited capacity, in view of the fact that the slope of the envelope is quite shallow beyond point 44 (FIG. 1), the envelope sample points in memory 204 can be spaced considerably further along the time axis (see arrow 10) than are the sample points stored in waveshape memory 20. Therefore, in order to drive the envelope address counter 206 by the same clock input (line 56) which is used for the waveshape address counter 22 (FIG. 3), a frequency divider 208 is used to divide down the clock input on line 56. The clock input is also controlled by an AND gate G4 in order that the envelope multiplication ratio may not start declining from its initial value of unity until the appropriate time.

The gate G4 requires a $\overline{Q}$ input from a flip-flop FF7, which initially is available because the start pulse on line 52 (from FIG. 3) initially resets the flip-flop. But when the last address of the envelope memory 204 is reached, a bit appears on the clock line of flip-flop FF7 which switches the flip-flop, terminating its $\overline{Q}$ output, and disabling the gate G4 to terminate the envelope generation cycle.

The start pulse on line 52 also initially resets and zeroes the envelope address counter 206, thereby assuring that the zero address of envelope memory 204 is selected first, so that the multiplier 200 starts off at a multiplication ratio of unity. This assures that during the first stages of waveform 11, the memory output is passed through the multiplier circuit 200 unchanged, and appears on a cable 26.

A digital-to-analog converter circuit 28 converts each successive envelope-modulated digital amplitude instruction on cable 26 into an analog voltage amplitude signal, and these analog signals appear in succession on an audio output line 58. The D/A converter circuit 28 also serves to integrate the audio output appearing on line 58, so that the transition from consecutive sample point voltage amplitudes is smoothed, and no ripple is detectable in the output at the frequency of the clock input 56.

In the circuit of FIG. 5, the envelope is superimposed upon the waveshape by means of digital circuitry. The alternative circuit of FIG. 6 accomplishes the same result by means of analog circuitry. The digital waveshape amplitude instructions on cable 24 are fed directly to the D/A converter 28 in this embodiment, without prior envelope processing. But the analog output of the D/A converter goes to a variable gain amplifier 300 which imposes the envelope upon the waveshape by suitable analog control of its gain. The gain control signal arrives over a line 302 coming from exponential generator circuit 304. The gain control signal on line 302 has the waveform depicted at 306. It starts with a voltage plateau 306A, and switches at an appropriate time to a concave exponential decay curve 306B. In order to obtain the initial plateau 306A, the start pulse on line 52 (FIG. 1) initially sets a set-reset flip-flop FF1. This permits the Q output to quickly charge a capacitor C through a blocking diode D. The fully charged capacitor C presents a continuous high positive voltage level (plateau 306A) through a unity gain buffer B to the gain control line 302, until the flip-flop FF1 is reset. Upon reset the Q output charging voltage terminates, permitting the capacitor C to discharge through a resistor R. The exponential decay curve 306B is the result of that capacitive discharge.

Figure 6:
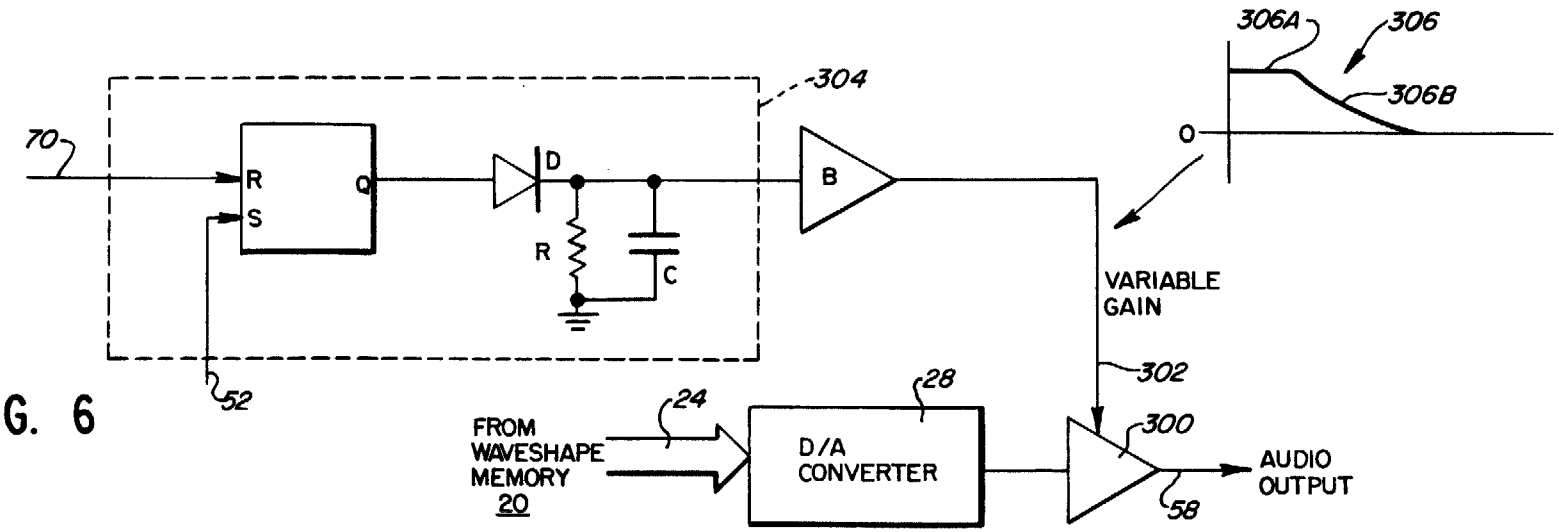
Figure 7:
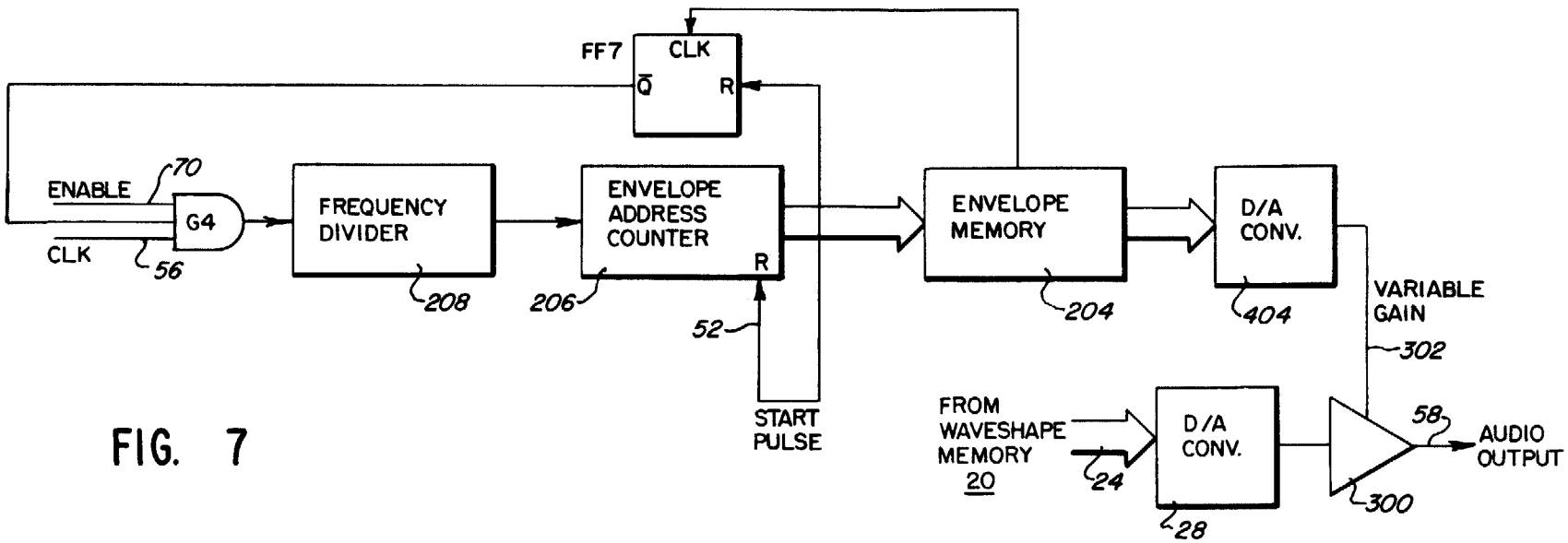

If FIG. 5 presents a wholly digital approach to the envelope, and FIG. 6 presents a wholly analog approach, FIG. 7 may be considered a hybrid approach. The envelope is generated digitally by the circuits G4, FF7, 208, 206 and 204 of FIG. 5, but the envelope is imposed upon the waveshape 11 at its analog stage by the amplifier 300 and gain control line 302 of FIG. 7. A second D/A converter 404 is used so that the digital envelope instructions coming from memory 204 are converted into the necessary analog voltage gain signal required on line 302.

One can also imagine a reverse hybrid approach, in which the analog envelope generator 304 of FIG. 6 is used to generate the analog exponential decay signal 306, which is then processed into digital form by an A/D converter and used to vary the gain of the digital multiplier 200 in FIG. 5.

The preferred envelope superimposition approach, however, involves the use of a special variable segment digital envelope claimed in my co-pending U.S. application Ser. No. 144,286 filed on the same date as this application, and entitled:

Returning to FIG. 3, in addition to the up/down count bit appearing on a line 53, the recirculate memory 62 stores a bit appearing on a line 63. This second bit, like the up/down count bit, is initially zero when the zero state of counter 54 accesses the zero address of memory 62. Accordingly, during the initial stages of waveform 11 flip-flop FF4 remains in its initially reset condition, and no Q output appears on an envelope enable line 70. But at an appropriate time, these conditions change, and an envelope enabling signal is generated.

Recirculate memory 62 contains a plurality of additional bits forming an address word which appears on a cable 64. The address word which is outputted on this cable initially (when counter 54 accesses the zero address of memory 62) is equal to the particular address of waveshape memory 20 (i.e. the particular point along the time line in FIG. 1) at which it is desired to turn on the envelope generator of FIGS. 5, 6 or 7. As previously discussed, this can be address 2000, or preferably it can be address 1000. If the latter alternative is adopted, the address 1000 initially appears in digital form on cable 64. Then, when the address counter 22 reaches the 1000th address of the waveshape memory 20, a digital comparator circuit 66 detects numerical equality between the digital inputs on cables 64 and 58, and produces an equality detection output pulse on line 68. This sets a set/reset flip-flop FF2 so that its Q output presents a high level to the D input of a D-type flip-flop FF3. Then, on the next high-going transition of a line 69, flip-flop FF3 will be switched into its high output state. (Line 69 carries the inverse of the clock on line 56, produced by inverter I). The high Q output of flip-flop FF3 is then used to perform two functions. For one thing, it goes through OR gate G1 to reset the set/reset flip-flop FF2 so that it will be ready the next time there is an output pulse from the comparator 66. In addition, the Q output of flip-flop FF3 clocks the counter 54, stepping it to the next count state, so that the next address of memory 62 is then accessed. And at this next memory address there is stored a one, which appears at the bit position of output line 63. Consequently, an output now appears which sets the set/reset flip-flop FF4, thus producing a Q output on line 70 which starts the envelope generation procedure by enabling gate G4 of FIG. 5 or 7, or by resetting the flip-flop FF1 of FIG. 6.

The flexibility provided by memory 62 permits this to happen at any desired time, by appropriate choice of the address of the memory bit which appears on line 63. The time chosen would ordinarily be when the waveshape memory 20 reaches any selected address at which the stored waveform peak amplitudes level off, as described above. In the specific example discussed above, this is address 1000.

At the same time that the envelope enable bit appears on line 63, address 2000, the address at which the first forward scan 31 (FIG. 2) is to end, appears on the output cable 64 of the recirculate memory. Then, when waveshape address counter 22 counts up to 2000, the next equality detection pulse appears on the output line 68 from comparator 66. This activates flip-flops FF2 and FF3 once more, and thus advances the recirculate step counter 54 one more step. The counter then accesses the next address of recirculate memory 62, at which point the bit on line 53 goes high, reversing the numerical count direction of the waveshape address counter 22, and bringing the first forward scan 31 (FIG. 2) to an end. Thereafter the waveshape address counter 22 counts down, and thus proceeds through the first rearward scan 32.

Each subsequent direction reversal is accomplished by continuing to advance the recirculate step counter 54, each time accessing the next successive address of recirculate memory 62, which causes the bit on line 53 to cycle back and forth between one and zero, so that the waveshape address counter 22 alternates between counting up and counting down.

The operation of the circuit in FIG. 3 continues in the manner described, with additional direction reversals at address 1400 resulting in a new forward scan (FIG. 2); at address 1700, resulting in a new rearward scan 34; at address 1100, resulting in a new forward scan 35; at address 1400, resulting in a new rearward scan 36; at address 1000, resulting in a new forward scan 37; at address 1600, resulting in a new rearward scan 38; at address 1300, resulting in one more forward scan 30; and again at address 1900, resulting in another rearward scan 40. At this point, the last address in the recirculate memory 62 is reached, and a pulse appears on a preset output line 74. This pulse serves to step the first stage of a two-stage shift register formed by D-type flip-flops FF5 and FF6. Two clock times later, the output of flip-flop FF6 enables AND gate G3.

The content of the last recirculate memory address is the numeral 1200, which in this example, is the end point for the last rearward scan 40. Consequently, when address counter 22 later concludes the last rearward scan 40 by returning to address 1200, producing yet another equality detection pulse on line 68, the resulting Q output from flip-flop FF3 will pass through the now enabled AND gate G3 to strobe a "preset" input P of the recirculate step counter 54. This preset operation does not reset the counter to zero, which would start the entire memory scan cycle of FIG. 2 all over again, including a repetition of the initial percussive rise 14A and the rapid decay portion of exponential phase 14B (FIG. 1). Instead, the counter 54 is preset to a count state represented by a hard-wired digital input on a cable 61. The particular count state selected bypasses the first address of recirculate memory 62 (which serves to initiate the envelope generation operation), because at this stage the envelope is already being generated. Instead, the recirculate step counter is jumped directly to the second address of recirculate memory 62, which points to waveshape address 2000, the take-off point for another recirculating scan 32–40 (FIG. 2).

In the meantime, the same last address of recirculate memory 62 which produced this output on line 74 also produces one more bit on line 53, which causes the numerical direction of address counter 22 to reverse once more, as a result of which the memory scan now proceeds numerically upward from address 1200, the concluding address of the last rearward scan 40. Since the recirculate step counter 54 is now preset to access recirculate memory address 2000, which terminates the first forward memory scan 31 (FIG. 2), the counter 54 now performs its count cycle over again, beginning with the scan direction reversal at the end of forward scan 31. Consequently, the recirculating memory scan, i.e. the alternating series of rearward and forward scans 31 through 40 will not be repeated, except that this time the first forward scan 31 starts at memory address 1200, not at memory address zero.

But throughout this repetition, and any subsequent repetitions, of the circulating scan cycle 31 through 40, the envelope continues to decrease monotonically until the amplitude drops to zero. With the envelope generators of FIGS. 5 and 7, the envelope address counter 206 will eventually access the last address of envelope memory 204, where an instruction for zero envelope amplitude is stored. With the envelope generator of FIG. 6 on the other hand, zero envelope amplitude is reached when capacitor C discharges fully. Thus, it will be appreciated that the resulting waveform 11 is aperiodic in the sense that its envelope is continually decreasing monotonically, no matter how many times any of the memory addresses are rescanned by the recirculating pattern 31–40, and no matter how many times the recirculating pattern itself is repeated, even until the envelope amplitude goes to zero.

In addition, the period of the entire recirculating scan cycle 31 through 40 is so extremely long, at least several seconds in duration, that the flutter frequency induced in the audio output by repeating the entire cycle is far too low to be heard. The human ear cannot detect a repetitive pattern having a period longer than about one second. As a result, there is no audible flutter frequency, in contrast to the half-cycle repetition rate flutter of prior art circuits such as that of Deutch et al.

Figure 4:
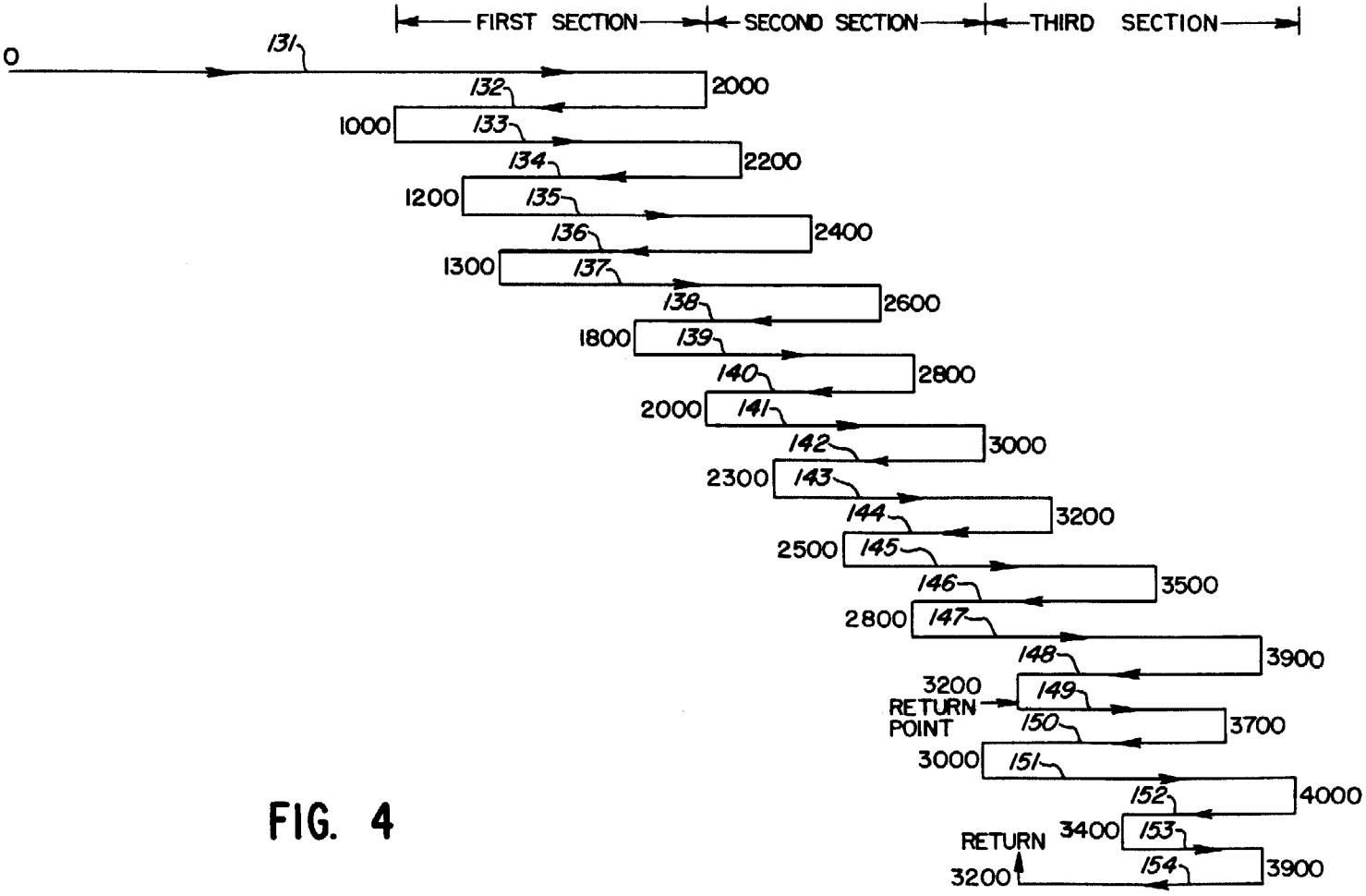
FIG. 4 is a diagram showing a memory address scan sequence for use in an alternative embodiment of a musical instrument in accordance with this invention, for producing a sound waveform having somewhat more sophisticated spectral characteristics.

As indicated above, additional realism is achieved by the memory scan depicted in FIG. 2 because of the fact that a selected spectral characteristic of waveform 11, such as the level of higher harmonic content, changes at a selected dividing line, e.g. memory address 1000. This, coupled with the fact that the rearward memory scans 32, 34, 36, 38 and 40 do not return below that dividing line, memory address 1000, permits the waveform 11 to progress monotonically from a region of one spectral characteristic, for example, a larger level of higher harmonic content, to a region of different spectral content, for example, a lower level of higher harmonic content, never thereafter returning to the original memory region containing the original level of higher harmonic content. In the alternate embodiment of FIG. 4 this concept is carried even further. The waveshape memory 20 is divided into four distinct regions. The first region, consisting of the first 1000 memory addresses, is again a region of the highest level of higher harmonic content, and is not re-entered after the address counter 22 begins its recirculating sequence of alternate rearward and forward memory scans. Here, as seen in FIG. 4, the waveshape memory 22 has a total of 4000 addresses, each containing respective amplitude instructions for the waveform 11. The last 3000 addresses are divided into three separate sections: the first section is memory addresses 1000 to 2000, the second section is memory addresses 2000 to 3000, and the third and final section is memory addresses 3000 to 4000. The amplitude instructions stored in the memory 22 are chosen so that the level of higher harmonic content represented by the information stored in memory addresses 1000 through 2000 is lower than the level of higher harmonic content in the first 1000 addresses. Similarly, the higher harmonic content level decreases from the 1000–2000 region to the 2000–3000 region, and decreases again from the 2000–3000 region to the 3000–4000 region. In addition, the invention employs a scan sequence which takes advantage of this monotonic harmonic gradient to produce a realistic sounding waveform 11 which progresses irreversibly toward lower levels of higher harmonic content over time.

One way of accomplishing this is to select the direction reversal points which are stored in the recirculate memory 62 so that each direction reversal point having a given polarity of change (for example, each reversal from the forward scan direction to the rearward scan direction) occurs at a higher memory address than its preceding reversal of that same polarity. For example, notice that in FIG. 4, the first nine reversals from the forward to the rearward direction occur at successively increasing addresses: 2000, 2200, 2400, 2600, 2800, 3000, 3200, 3500 and 3900. Similarly, the first nine reversals of opposite polarity (i.e. from the rearward to the forward direction) also occur at addresses which increase monotonically: 1000, 1200, 1300, 1800, 2000, 2300, 2500 and 2800.

Another way of defining a memory scan pattern which progresses irreversibly is to select the direction reversal points stored in the recirculate memory 62 so that the center point of each successive scan, of whatever direction, is always at a higher address than the center point of any preceding scan of any direction. For example, in FIG. 4, the first scan, which is scan 131 in the forward direction, goes from address 0 to address 2000; therefore, its center point is address 1000. The next scan in sequence, which is rearward scan 132, goes from address 2000 to address 1000; therefore, its center point is address 1500, which is higher than address 1000, the center point of the preceding scan 131. This pattern continues for the first eighteen scans of either direction 131 through 148; the scan midpoint address is always higher than the midpoint address of any previous scan, regardless of scan direction.

However, both of the above scan pattern definitions are departed from by at least some of the scans 149 through 154. Here, the scan pattern for achieving an irreversible progression of higher harmonic content must be defined in a somewhat different way. In FIG. 4, the first rearward scan 132 runs from address 2000 to address 1000; therefore, its midpoint is at address 1500, which is located within the first recycling section of memory addresses, i.e. the section between address 1000 and address 2000. The following scans 133, 135, 135 136 and 137 also all have their midpoints within the first recycling section, i.e. somewhere between addresses 1000 and 2000. Finally, beginning with scan 138, the scan midpoint has moved into the second recycling section, i.e. it is located between memory addresses 2000 and 3000. The defining characteristic here is that once the midpoint of any scan has crossed over from the first recycling section 1000–2000 into the second recycling section 2000–3000, the midpoint of any succeeding scan does not thereafter return to the first recycling section, even though the lower address end of that scan may do so. Thus, the midpoints of scans 138, 139, 140, 141, 142, 143 and 144 are all within the second recycling section, consisting of memory addresses 2000 through 3000; while scan segment 145 has its midpoint exactly at memory address 3000 which is the boundary line between the second recycling section and the third recycling section.

Starting with scan segment 145, the midpoints of all the remaining scans 145 through 154 are within the third recycling section, memory addresses 3000–4000.

Here it is not true that the midpoint of each successive memory scan moves monotonically to ever higher addresses. For example, the midpoint of scan 149 is at a lower, not a higher, address than that of scan 148; the midpoint of scan 153 is at a lower, not a higher, address than that of scan 152; and the midpoint of scan 154 is at a lower, not a higher, address than that of scan 153. Nevertheless, one of the criteria of spectral progression is satisfied, because it remains true that once the midpoint of a given scan has crossed over into the third recycling section, memory addresses 3000–4000, thereafter the midpoints of all succeeding scans, although they may retreat to a somewhat lower address, do not retreat below the sectional boundary address 3000. Consequently, the average higher harmonic content, once it has dropped to the level of section three, does not thereafter climb back to the level of section two or section one. In that sense, there is an irreversible progression of average spectral characteristics, as the waveshape address counter goes through the sequence of scans 131 through 154.

Finally, at the end of scan 154, the sequence returns to address 3200, and begins repeating the cycle with scan 149. It does not, therefore, return either to the first recycling section (memory addresses 1000–2000) or the second recycling section (memory addresses 2000–3000), but confines all remaining scan iterations to the third recycling section (memory addresses 3000–4000) and thus to the lowest level of higher harmonic content, i.e. the final average spectral characteristic toward which the scan has been irreversibly progressing.

It will now be more fully appreciated that this invention successfully adapts the memory saving advantages of the recirculating address technique to the production of long aperiodic sound waveforms. It does so without allowing audible flutter at the memory recycling frequency, and it also manages to produce a monotonic change in average spectral characteristics, despite the need for direction reversal and rescanning of memory addresses.

The embodiments disclosed, while preferred, are merely illustrative of the range of variations which may fall within the scope of this invention, as it is claimed below.

What is claimed is:

1. In an electronic musical instrument of the type having a memory with a plurality of sample point waveform amplitude instructions stored at respective addresses therein, a counter for accessing said memory addresses in numerical sequence, said counter being reversible to count numerically up or down for accessing said memory addresses in forward or reverse numerical sequence, means for stepping said counter, means effective at the conclusion of one or more forward scans of said memory addresses to reverse the direction of said counter so as to initiate one or more rearward scans of said memory addresses, and means responsive to said memory to produce a waveform the amplitude of which at each sample point is a function of the respective amplitude instruction stored at the memory address corresponding thereto; the improvement wherein:

said memory is characterized by a selected boundary address, the waveform characteristics dictated by the amplitude instructions stored at memory addresses located numerically before said boundary address differing from the waveform characteristics dictated by the ampltiude instructions stored at memory addresses located numerically after said boundary address;

and said instrument comprises means for effecting an initial forward scan between a first memory address numerically smaller than said boundary address and a last memory address numerically larger than said boundary address and further comprising means effective to terminate each of said forward and each of said rearward scans subsequent of said initial scan at one or more memory addresses each located at or numerically after said boundary address with at least some of said one or more memory addresses being different from said first and last memory addresses of said initial forward scan and from said boundary address;

whereby the waveform characteristics dictated by amplitude instructions stored at memory located numerically before said boundary address are not repetitively accessed.

2. An electronic musical instrument of the type having a memory with a plurality of sample point waveform amplitude instructions stored at respective addresses therein, an up/down counter for accessing said memory addreses in forward or reverse numerical sequence, means effective at the conclusion of an initial forward scan of said memory addresses to reverse the direction of said counter so as to initiate an initial rearward scan of said memory addresses, means for stepping said counter, and means responsive to said memory to produce an output waveform the amplitude of which at each sample point is a function of the respective amplitude instruction stored at the memory address corresponding thereto; wherein the improvement comprises;

means effective during said initial rearward scan of said memory addresses to reverse the direction of said counter once more so as to initiate a second foward scan starting at an intermediate memory address between the first and last of said memory addresses in said initial forward scan and effective during said second forward scan to reverse the direction of said counter once again so as to initiate a second rearward scan at an intermediate memory address between the first and last of said memory addresses in said initial forward scan.

3. An electronic musical instrument as in claim 2 wherein said two intermediate memory addresses at which said scan reversals take place are not the same.

4. An electronic musical instrument as in claim 3 wherein said means for reversing said rearward scan and said means for reversing said second forward scan each repeat their respective reversals at least one additional time, whereby to produce a composite scan including four or more direction reversals, each of the memory addresses at which said four or more reversals occur being intermediate addresses between the first and last of said memory addresses in said initial forward scan.

5. An electronic musical instrument as in claim 4 wherein none of said intermediate addresses at which a reversal of any given polarity takes place is identical to any other of said intermediate addresses at which a reversal of the same polarity takes place.

6. An electronic musical instrument as in claim 5 wherein none of said intermediate addresses at which a reversal of scan direction takes place is identical to any other of said intermediate addresses at which a reversal of scan direction takes place, regardless of whether said reversals are of the same or of opposite polarity.

7. An electronic musical instrument as in claim 2 wherein said means for reversing said initial rearward scan and said means for reversing said second forward scan each repeat their respective reversals at least one additional time whereby to produce a composite scan including four or more direction reversals all occurring after the reversal of said initial forward scan, none of said reversals of any given polarity occurring at the same memory address as any other reversal of the same polarity.

8. An electronic musical instrument as in claim 7 wherein:

said amplitude instructions are so selected that all the amplitude instructions stored at least one later group of memory addresses, located after a selected boundary address, specify an output waveform which is different in spectral content from the output waveform specified by those amplitude instructions which are stored at all the memory addresses in an earlier group which is located before said boundary address;

and said reversing means are arranged so that prior to a transition state of said composite scan all the successive reversals of any given polarity shift to successively later memory addresses so that there is a monotonic shift of the median address of each successive forward and rearward scan toward said later group of memory addresses and after said transition state of said composite scan all the reversals of both polarities occur at memory addresses selected so that the median address of each forward and rearward scan is within said later group of memory addresses;

whereby after said transition state said output waveform is at least predominantly characterized by said different spectral content.

9. A method of using an electronic musical instrument of the type having a memory with a plurality of sample point waveform amplitude instructions stored at respective addresses therein, a counter for accessing said memory addresses in numerical sequence, said counter being reversible to count numerically up or down for accessing said memory addresses in forward or reverse numerical sequence, means for stepping said counter, means effective at the conclusion of one or more forward scans of said memory addresses to reverse the direction of said counter so as to initiate one or more rearward scans of said memory addresses, and means responsive to said memory to produce a waveform the amplitude of which at each sample point is a function of the respective amplitude instruction stored at the memory address corresponding thereto, said method comprising the steps of:

selecting said amplitude instructions so that the waveform characteristics dictated by the amplitude instructions stored at memory addresses located numerically before a selected boundary address differ from the waveform characteristics dictated by the amplitude instructions stored at memory addresses located numerically after said boundary address;

effecting an initial forward scan between a first memory address numerically smaller than said boundary address and a last memory address numerically larger than said boundary address;

and terminating each of said forward and each of said rearward scans subsequent of said initial scan at one or more memory addresses each located at or numerically after said boundary address with at least some of said one or more memory addresses being different from the first and last memory addresses of said initial forward scan and from said boundary adress;

whereby the waveform characteristics dictated by amplitude instructions stored at memory addresses located numerically before said boundary address are not repeated after said first forward scan of memory addresses.

10. An electronic musical instrument of the type having a waveshape memory with a plurality of sample point waveform amplitude instructions stored at respective addresses therein, an up/down address counter for accessing said waveshape memory addresses in forward or reverse numerical sequence, means for stepping said up/down address counter, and means responsive to said waveshape memory to produce an output waveform the amplitude of which at each sample point is a function of the respective amplitude instructions stored at the waveshape memory address corresponding thereto; wherein the improvement comprises:

means for reversing the direction of said up/down counter including a recirculate memory storing a plurality of direction reversal instructions at respective addresses therein, a comparator connected to compare the direction reversal instruction presently offered by said recirculate memory with the wave-shape memory address presently offered by said up/down counter, and producing an output when said compared quantities are equal, means responsive to said equality detection output of said comparator to reverse the count direction of said up/down counter, and means operable in response to said equality detection output of said comparator for accessing successive addresses of said recirculate memory.

11. An electronic musical instrument as in claim 10 further comprising an envelope generator adapted to modify the amplitude of said output waveform, means for tuning said envelope generator on and off in response to said recirculate memory, and data stored at a selected address in said recirculate memory, for tuning on said envelope generator at a selected phase of said output waveform.

12. An electronic musical instrument as in claim 10 wherein said means responsive to said equality detection output includes: said recirculate memory; a recirculate step counter operable for accessing the memory addresses of said recirculate memory; means responsive to said equality detection output of said comparator to advance said recirculate step counter; and an output from said recirculate memory connected to control count direction reversal of said up/down addres counter; said recirculate memory storing information for reversing the count direction of said up/down counter each time said comparator detects equality of said compared quantities.

13. A method of using a electronic musical instrument of the type having a memory with a plurality of sample point waveform amplitude instructions stored at respective addresses therein, an up/down counter for accessing said memory addresses in forward or reverse numerical sequence, means programmable to reverse the direction of said counter for forward and rearward scans of said memory addresses, means for stepping said counter, and means responsive to said memory to produce an output waveform the amplitude of which at each sample joint is a function of the respective amplitude instruction stored at the memory address corresponding thereto; said method comprising the step of:

programming said reversing means to reverse the direction of said counter once at the end of an initial forward scan so as to initiate a reverse scan, and again during said reverse scan so as to initiate a second forward scan starting at an intermediate memory address between the first and last of said memory addresses in said initial forward scan; and programming said reversing means to reverse the direction of said counter once again having said second forward scan so as to initiate a second rearward scan at an intermediate memory address between the first and last of said memory addresses in said initial forward scan.

14. A method as in claim 13 wherein said two intermediate memory addresses at which said scan reversals take place are not the same.

15. A method as in claim 14 comprising the step of programming said reversing means to repeat each of said reversals at least one additional time, whereby to produce a composite scan including four or more direction reversals, each of the memory addresses at which said four or more reversals occur being intermediate addresses between the first and last of said memory addresses in said initial forward scan.

16. A method as in claim 15 none of said intermediate addresses at which a reversal of any given polarity takes place is identical to any other of said intermediate addresses at which a reversal of the same polarity takes place.

17. A method as in claim 15 wherein none of said intermediate addresses at which a reversal of scan direction takes place is identical to any other of said intermediate addresses at which a reversal of scan direction takes place, regardless of whether said reversals are of the same or of opposite polarity.

18. A method as in claim 13 comprising the additional step of programming said reversing means to repeat said reversals at least one additional time each, whereby to produce a composite scan including four or more direction reversals all occurring after the reversal of said initial forward scan, none of said reversals of any given polarity occurring at the same memory address as any other reversal of the same polarity.

19. A method as in claim 18 comprising the additional steps of:

defining a selected boundary address of said memory and a selected transition state of said composite scan;

selecting said amplitude instructions so that all the amplitude instructions stored at at least one later group of memory addresses, located after said selected boundary address, specify an output waveform which is different in spectral content form the output waveform specified by those amplitude instructions which are stored at all the memory addresses in an earlier group which is located before said selected boundary address;

and programming said reversing means so that prior to said transition state of said composite scan all the successive reversals of any given polarity shift to successively later memory addresses so that there is a monotonic shift of the median addresses of each successive forward and rearward scan toward said later group of memory addresses and after said transition state of said composite scan all the reversals of both polarities occur at memory addresses selected so that the median addresses of each forward and rearward scan is within said later group of memory addresses;

whereby after said transition state said output waveform is at least predominantly characterized by said different spectral content.

* * * * *